US006688234B2

(12) United States Patent
Huber et al.

(10) Patent No.: US 6,688,234 B2
(45) Date of Patent: Feb. 10, 2004

(54) SYMMETRICAL PAINT BALL LAND MINE

(75) Inventors: Eric D. Huber, Barling, AR (US); Michael E. Huber, Westfork, AR (US)

(73) Assignee: Paintball Combat LLC, Barling, AR (US)

( * ) Notice: Subject to any disclaimer, the term of this patent is extended or adjusted under 35 U.S.C. 154(b) by 0 days.

(21) Appl. No.: 10/142,107

(22) Filed: May 9, 2002

(65) Prior Publication Data

US 2003/0209163 A1 Nov. 13, 2003

(51) Int. Cl.[7] ..... F42B 8/28

(52) U.S. Cl. ..... 102/498; 102/401; 102/513; 102/502

(58) Field of Search ..... 102/401, 407, 102/366, 367, 498, 513, 529; 103/502; 124/526; 222/195

(56) References Cited

U.S. PATENT DOCUMENTS

| | | | | | |
|---|---|---|---|---|---|
| 2,475,008 | A | | 7/1949 | Catherwood, Jr. | |
| 2,843,042 | A | * | 7/1958 | Lazari | 102/275 |
| 3,540,136 | A | * | 11/1970 | Billingsley | 434/11 |
| 3,564,756 | A | | 2/1971 | Gunpei Yokoi | |
| 3,994,227 | A | * | 11/1976 | Harvey | 102/404 |
| 4,418,623 | A | * | 12/1983 | Gauchard | 102/369 |
| 4,690,061 | A | | 9/1987 | Armer, Jr. et al. | |
| 4,944,521 | A | | 7/1990 | Greeno | |
| 5,018,449 | A | | 5/1991 | Eidson | |
| 5,069,134 | A | * | 12/1991 | Pinkney | 102/368 |
| 5,216,198 | A | * | 6/1993 | Bourgin | 102/401 |
| 5,354,225 | A | * | 10/1994 | Hix | 446/180 |
| D366,283 | S | | 1/1996 | Fernandes | |
| 5,590,886 | A | | 1/1997 | Lush | |
| 5,877,448 | A | | 3/1999 | Denton | |
| 5,996,503 | A | | 12/1999 | Woodall | |
| 6,289,819 | B1 | | 9/2001 | Dolderer | |
| 6,453,819 | B1 | * | 9/2002 | Coates | 102/498 |
| 2002/0166474 | A1 | * | 11/2002 | Wygant | 102/401 |

* cited by examiner

*Primary Examiner*—Charles T. Jordan
*Assistant Examiner*—Susan C. Alimenti
(74) *Attorney, Agent, or Firm*—Stephen D. Carver

(57) ABSTRACT

A paint ball land mine comprising multiple PVC parts detonates and marks simulated casualties. The mine may be easily field stripped by hand. The mine forcibly detonates in response to physical contact without unbalancing, so that tilting forces that otherwise misaim the mine are avoided. A rigid cylindrical two-part base threadably receives a removable top. A sealed interior for holding colored fluid is defined therebetween. A gas cartridge housed vertically interiorly of the base may be detonated when forced into contact with a puncture pin. An integral, upwardly projecting dome mounts a detonator assembly, comprising a tubular plunger that slidably contacts the cartridge when fired. Escaping gases pressurize the mine interior, forcing colored liquid upwardly and outwardly through multiple discharge passageways that are angled acutely to aim fluid away from the center. A removable safety pin, temporarily engaging the plunger, may be "pulled" to "set" the mine.

19 Claims, 8 Drawing Sheets

SYMMETRICAL PAINT BALL LAND MINE

BACKGROUND OF THE INVENTION

I. Field of the Invention

The present invention relates generally to land mines. More particularly, our invention relates to non-lethal land mines used for combat simulation and the game of paintball. The most pertinent known prior art is believed properly classified in U.S. Patent Class 102, Subclasses 401 and 407.

II. Description of the Prior Art

Simulated war games involving "safe" or "harmless" weapons have long been used for military training purposes. Adequate practice weapons are vital in conditioning soldiers during basic training. Training devices like mines, grenades and rifles often visually appear like the "real thing," being shaped and colored approximately the same, and often weighing the same as well. Training weapons can readily sharpen combat skills, and their use can facilitate objectively scoring of drills and combat simulation exercises. Numerous simulated weapons including practice mines and grenades have evolved for use in training exercises. Rifles having the "look and feel" of modern automatic combat arms may include laser systems for registering with target laser-receptors worn by the participants. When a target registers a laser "hit" a casualty is simulated. This type of device develops both the skill of the user, and the apprehension or caution of the simulated victim.

The developing phenomenon of "paint ball" provides a simulated war game. The popularity of paint ball, and the number of participants, have both grown tremendously in number in recent years. Regular "events" and combat simulating sessions are commonly scheduled throughout the country. The game has become very popular amongst civilians, i.e., non-military personnel, who delight in the games challenges. The ever-developing popularity of paint ball has concurrently increased the demand for a wide variety of paint ball guns and accessories.

Paint ball games utilize a diverse collection of usually hand-held "firearms" that are gas-operated. The most common paint ball weapon is a gas-operated "rifle" that shoots paint balls. Modern paint ball hand guns and rifles dependably fire paint ball "ammunition" approximately fifty to one hundred feet. The propellant comprises compressed air or carbon dioxide, stored in removable gas cartridges removably fitted within the weapon. Paint ball guns have evolved from single shot pistols and rifles to modern, semi-automatic and full-automatic "machine guns" characterized by a high rate of paint ball firing.

Common ammunition (i.e., "paint balls") comprises spherical capsules, of approximately 68 caliber, which have a deformable periphery made of non-poisonous gelatin, plastic or the like. Paint ball capsules contain a safe and chemically harmless liquid or dye that is very brightly and distinctively colored. When impacting a target within range, paint balls rupture, and the paint or dye is widely dispersed upon the impacted target, clearly and unambiguously marking it as "hit."

Multiple players may be arranged in opposing teams that employ various strategies and tactics according to established rules. For example, competing teams may be provided with a distinctive flag that must be defended against capture by the opposition. When a projectile impacts a target, colored liquid is widely splattered as the projectile disintegrates with an audible "splat." Usually, when a player is shot by a paint ball, he or she is considered a casualty of war, and is usually disqualified from further play. Because bright colors are unmistakably splattered upon the "victim," the scoring of hits or casualties is objectively enhanced. When the colorant strikes the target (i.e., opposing personnel), that target or person is identified by the colorant as being eliminated from the game.

While the majority of weapons for simulated war gaines comprise various forms of "guns," various simulating "grenades" and mines have come into widespread use. Most known devices suitable for paint ball employ internal pressurized gas cylinders for detonation.

U.S. Pat. No. 4,944,521 issued to Greeno on Jul. 31, 1990 discloses a paint ball or combat training grenade that discharges paint ball projectiles or capsules. The hand grenade has an elongated, elliptical housing with a central passageway coaxially extending through the housing. An internal piercing mechanism actuated by the grenade handle pierces an enclosed gas cylinder when the user sets off the grenade. Pressurized gas outputted by the cylinder enters a plurality of internal channels and propels paint ball projectiles from sides of the grenade. Players contacted by the high-speed grenade projectiles are marked with distinct colors from internal fluid as the splashing projectiles disintegrate.

U.S. Pat. No. 5,018,449 issued to Eidson on May 28, 1991 shows another training grenade. The rigid grenade body has numerous internal discharge passages externally extending from an internal central bore. Prior to throwing the grenade, a user conventionally pulls the grenade handle. After a predetermined delay, an internal piston forcibly ruptures an internal capsule containing colored fluid, and the fluid is propelled from the grenade body via the discharge passages, contacting and marking anyone within range of the thrown grenade.

U.S. Pat. No. 5,590,886 issued to Lush on Jan. 7, 1997 discloses a reusable paint ball grenade that employs standard paint balls. When thrown towards a target, an actuator fires upon impact, crushing internal paint balls against cutters and forcibly expelling the colored paint.

Another grenade is seen in U.S. Pat. No. 5,996,503 issued to Woodall et. al. on Dec. 7, 1999. This reusable, gas powered grenade has a number of internal launch tubes in which projectiles are loaded. A sealed, internal reservoir stores pressurized gas. A rupturing device is mounted in the housing for breaking the reservoir's seal upon impact. A triggering mechanism coupled to the rupturing device maintains separation between the rupturing device and the seal until the triggering mechanism is activated. Once activated, the triggering mechanism moves the rupturing device to impact the seal so that gas pressure propels the projectiles from the launch tubes.

U.S. Pat. No. 6,289,819, issued to Dolderer on Sep. 18, 2001, discloses a paint ball land mine capable of propelling standard caliber paint balls. It simulates a U.S. military Claymore anti-personnel mine. A discharge tube is configured to receive a pyrotechnic charge in the form of a 12 gauge shotgun blank round and/or a .38 caliber blank round. In a preferred embodiment a firing pin is pivotally attached in operative relation to the pyrotechnic charge and spring-biased into contact therewith. A trigger mechanism including a trip pin fixedly attached to a trip wire is interposed between the pyrotechnic charge and the firing pin. When a participant comes into contact with the trigger mechanism the paintballs are propelled at a velocity up to 200 feet per second.

U.S. Pat. No. 5,877,448 issued to Denton et. al. Mar. 2, 1999 discloses a reusable gas-powered land mine comprising at least one launch tube and projectile. A compressed gas reservoir is ruptured by a triggering mechanism when the mine is activated, and freed, compressed gases are directed to the breech end of the launch tubes to forcibly eject the temporarily constrained paint ball projectiles.

The closest prior art reference known to us comprises U.S. Pat. No. 4,690,061 issued to Armer, Jr. , et al. on Sep. 1, 1987, which depicts a land mine for use in conjunction with simulated war games. The mine comprises a housing internally containing a first chamber holding a colored slurry and dispersing agent. A second chamber in fluid flow communication with the first chamber secures a pressurized cylinder containing propellant gas. A trigger mechanism having a portion extending externally of the mine is internally linked to the cylinder activator. Detonation of the mine occurs in response to physical contact by an unwary player with a trip wire. Upon activation, the suddenly-applied gas pressure propels the slurry from the mine, vigorously discharging it exteriorly of the housing towards the victim. The output pattern is determined by a peripheral, rotational receptacle that generally directs fluid in a pattern parallel with the upper surface of the mine.

Many problems are associated with conventional paintball grenades. Since the devices fire paint balls, rather than mere fluid, range is limited and premature rupturing of the paintballs can occur during handling. Many designs store paintballs with a portion exposed exteriorly of the grenade housing, where inadvertent mechanical contact can destroy the paint ball. Common problems of alignment during installation exist. For example, "squarish" or rectangular mines that simulate Claymore Mines can be difficult to install within the ground in a balanced fashion. Often the plunger mechanism is offset from the center of mass of the housing. When haphazardly engaged by human contact, the mine may simply bend or rock within the ground, rather than firing.

It is important that paint ball mines avoid rocking or tilting when stepped-upon. Forces from pedestrian contact must be absorbed properly by the firing mechanism, which should smoothly retreat into the housing, sliding vertically into forcible, penetrating contact with the gas cylinder. Dependable firing requires smooth, "unjammed" operation, which is enhanced by an overall concentric design that prevents oblique forces from tilting the mine. Further, commercially worthwhile practice mines suitable for paint ball use should be refillable without special tools or equipment. In other words, a viable paint ball mine should be field strippable, and reloadable, with a minimum of effort. Reuse of suitable mines must be possible without the requirement of multiple hand tools or heavy or cumbersome auxiliary equipment. Finally, successful mines must reliably function in an extreme environment, where they are subjected to moisture and dirt when properly buried.

SUMMARY OF THE INVENTION

Our improved land mine comprises a number of cooperating, preferably PVC plastic parts that are symmetrically assembled to maximize efficiency and minimize failure. We have developed a highly reliable and effective paint ball landmine that can be easily reused. Our mine may be easily field stripped and cleaned or reloaded without the cumbersome hand tools or machines.

The preferred mine is constructed from symmetrically arrayed, internal parts that promote reloading efficiency and ease of deployment. When stepped upon by a paint ball player, the mine forcibly and effectively discharges colored liquid in a vertical pattern, thus contacting and "marking" the player. Human contact occurs without unbalancing the mine, so that forces tend to be directed downwardly into the apparatus without tilting, dependably detonating the mine.

The preferred mine comprises a rigid, generally cylindrical, two-part base defining a sealed interior for holding colored dye or fluid to be forcibly discharged from the mine upon detonation. A gas cartridge is housed vertically within a special tube glued interiorly of the base, immediately proximate a puncturing pin. The mine is sealed by a top that is removably, threadably secured to the base. These two major portions may be field stripped and disassembled or reassembled with a minimum of operator inconvenience or effort. Reloading (i.e., cartridge replacement combined with fluid refilling) is facilitated in this fashion without requiring special tools or equipment.

The housing top has an integral, upwardly projecting dome at its center, that slidably receives a detonator assembly which is activated and depressed by physical contact. The detonator assembly comprises an elongated, tubular plunger slidably captivated through a passageway defined in the dome. The plunger contacts the cartridge to force it downwardly into penetrating contact with the puncturing pin during mine activation. When the cartridge is punctured, its compressed gases pressurize the mine interior, forcing the colored dye outwardly through suitable discharge passageways that are formed in the top's lower deck. The multiple, spaced apart discharge passageways are angled acutely to aim ejected fluid away from the mine's center, insuring a casualty.

The PVC detonator comprises a tubular plunger which extends through the dome into the mine interior into physical contact with the gas cartridge. A plunger end cap seals the plunger 64, and prevents it from falling into the mine interior by limiting downward travel. Inadvertent plunger withdrawal is prevented by a pair of retention screws that can contact the dome interior. A safety pin, temporarily inserted through the plunger, normally prevents it from depressing the gas cartridge. Once the safety pin is "pulled" and withdrawn from the plunger, the mine is "set", and future physical contact with the plunger will detonate the mine.

It is therefore a broad object of our invention to provide a highly reliable and easily deployable land mine for use in combat training, or for use in paint ball games.

Another important object of our invention is to provide a simulated land mine that may be easily installed and deployed by players, but which forcibly "marks" opposing players that step on it in a vigorous and forceful manner.

A still further object is to provide a simulated land mine that may be employed for training combat soldiers.

Another object is to provide a paint ball landmine that is safe to use and incapable of injuring those who are properly-prepared and properly-equipped.

Another important object of our invention is to provide a land mine that is non-pyrotechnic and non-lethal, and which is safe for use by properly-equipped participants.

Further, it is an object of our invention to unmistakably and unambiguously mark any player or trainee who steps on the mine as a simulated casualty.

Another object is to provide a mine of the character described that uses an inert, and chemically non-reactive, nonpoisonous, and washable fluid.

A related object is to provide a paint ball land mine of the character described whose dispersal pattern upon detonation reliably covers a sufficiently wide area so as to dependably inflict easily recognizable "casualties."

Another important object of our invention is to provide a simulated land mine of the character described that may be easily and inexpensively refilled and reloaded after detonation for reuse.

A related object is to provide a simulated mine of the character described that uses bulk marker fluid. It is a feature of the invention that a large internal reservoir of colored fluid is used for target marking instead of paint balls, so users costs are reduced and reloading complexity is minimized.

Another basic object of our invention is to provide a land mine that can be used in military and non-military war games.

Yet another object is to provide a reusable land mine of the character described that is easily deployed, easily concealed, and which is substantially maintenance free.

Another important object is to provide a simulated land mine of the character described that adds realism and excitement to training exercises or the game of paint ball.

A further object is to maximize safety by, for example, avoiding high explosives and/or the use of pyrotechnic or ballistic propellants, and/or the use of corrosive or poisonous marker fluids.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
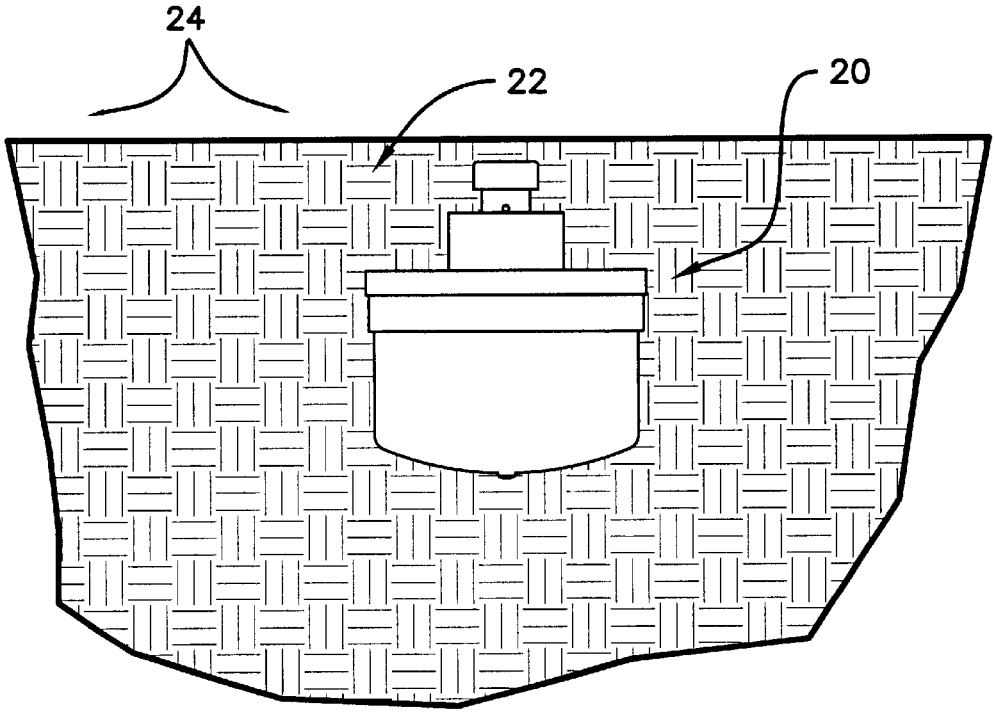
FIG. 1 is a fragmentary isometric view showing our new land mine installed for use, partially buried in the ground, with the safety pin pulled.
Figure 2:
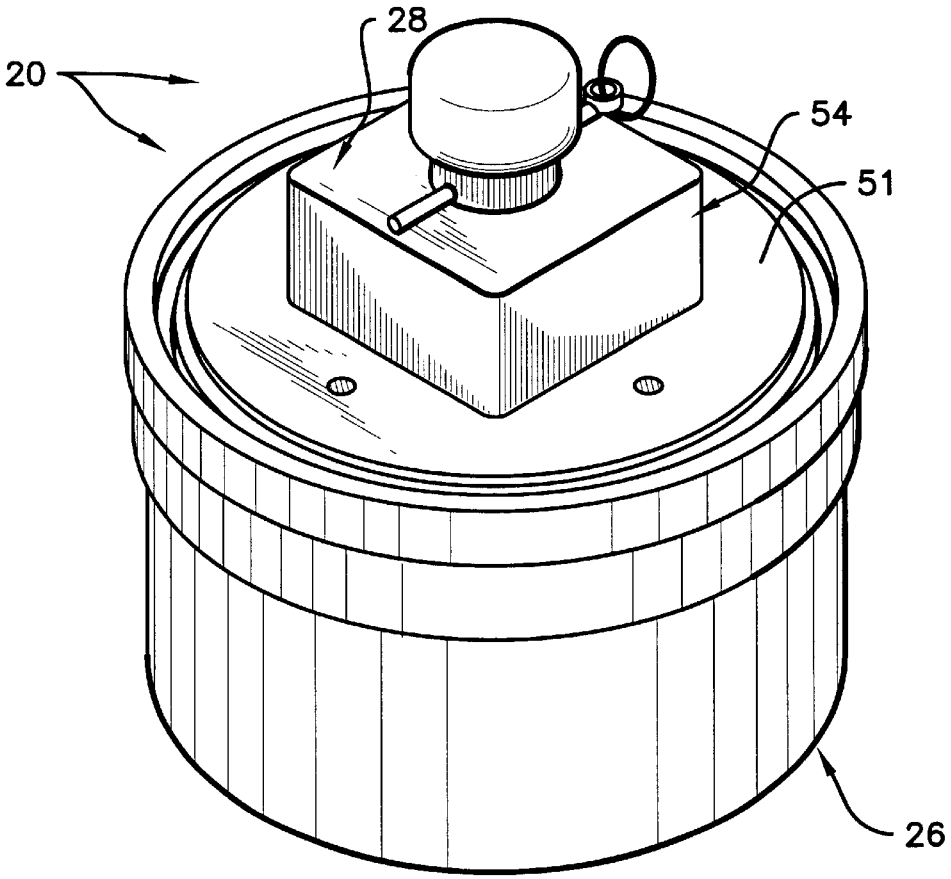
FIG. 2 is an enlarged, isometric view of our land mine with the safety pin installed.
Figure 3:
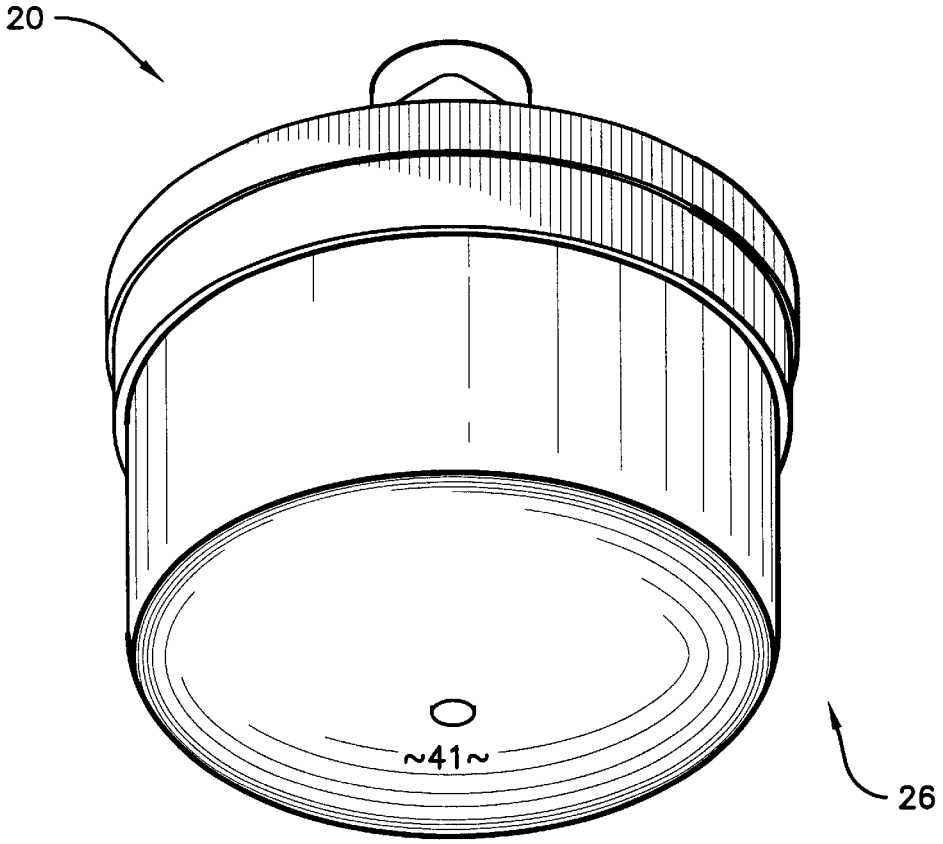
FIG. 3 is a bottom isometric view thereof.
Figure 5:
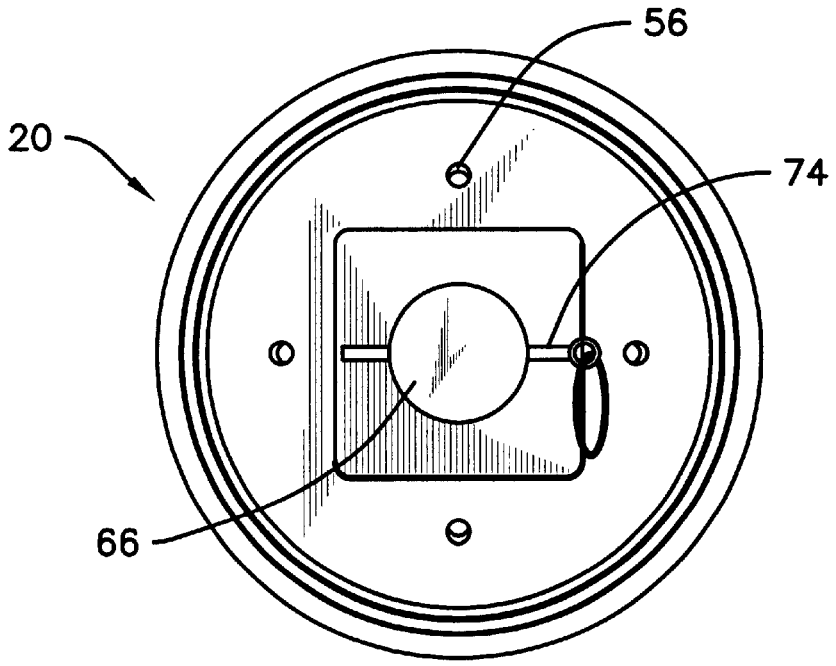
FIG. 5 is a bottom plan view thereof.
Figure 4:
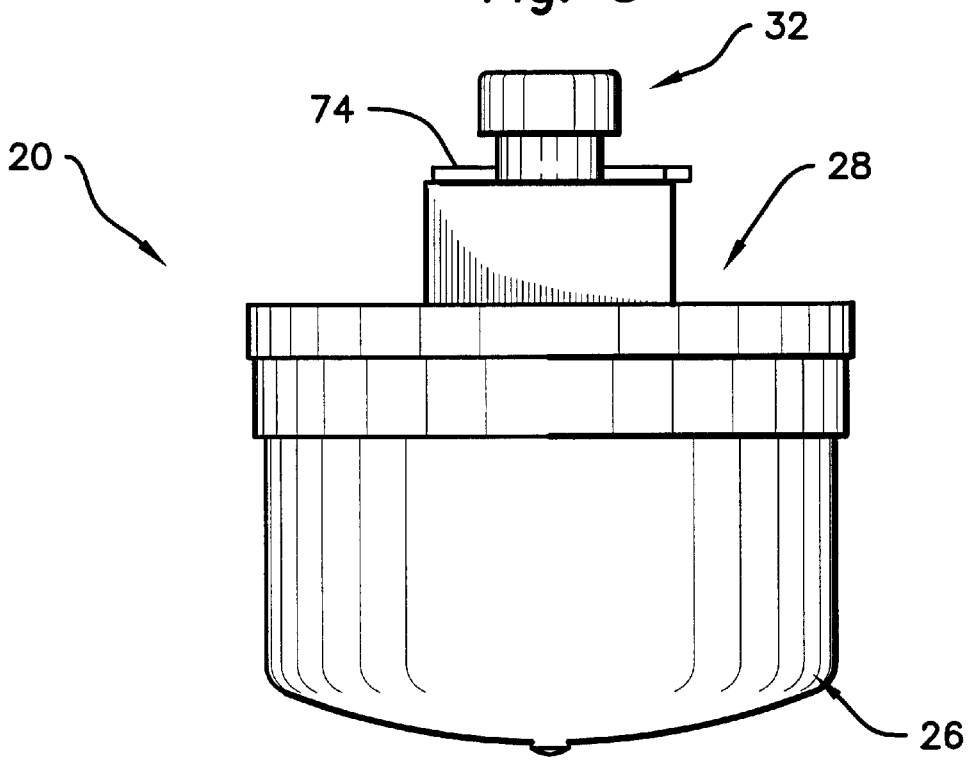
FIG. 4 is a front plan view thereof.
Figure 7:
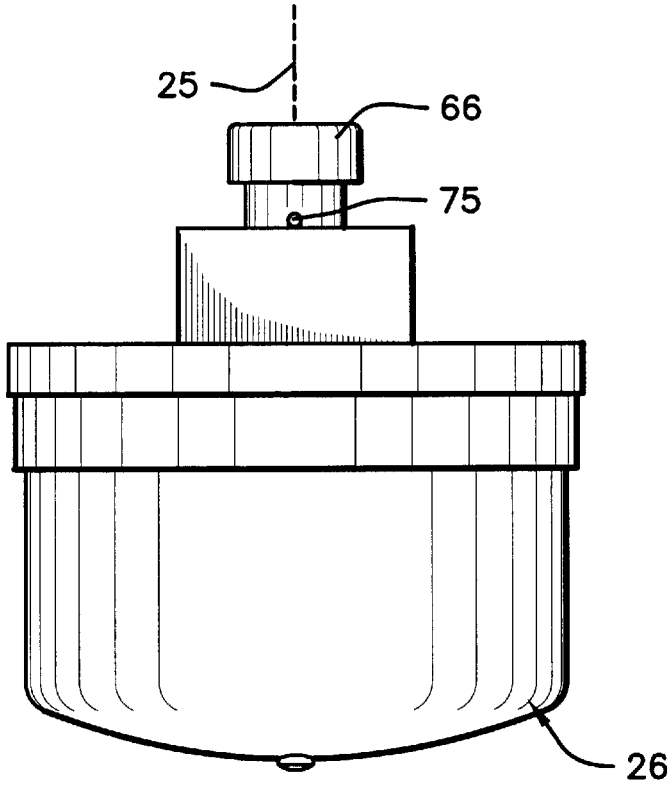
FIG. 7 is a left side elevational view thereof.
Figure 6:
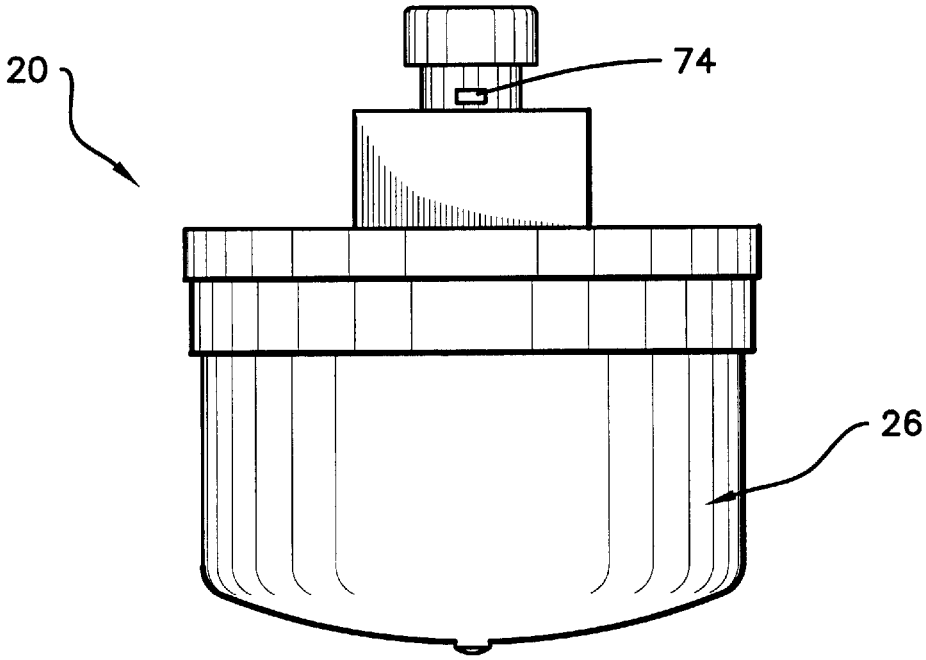
FIG. 6 is a right side elevational view thereof.

With initial reference directed to FIGS. 1–3 of the appended drawings, the reference numeral 20 generally denotes our improved land mine. Mine 20 is adapted to be partially buried or concealed within ground 22, proximate a region 24 that is likely to be traversed by members of an opposing paint ball team, or by other soldier trainees. When mine 20 is haphazardly contacted, as described in detail hereinafter, it detonates-rapidly and forcefully spraying dye or colored marker fluid about the region 24 above the mine to plainly and unambiguously "mark" the pedestrian who stepped on it. At the same time, no rigid mechanical parts or projectiles are expelled, preserving the relative safety of the players.

Figure 8:
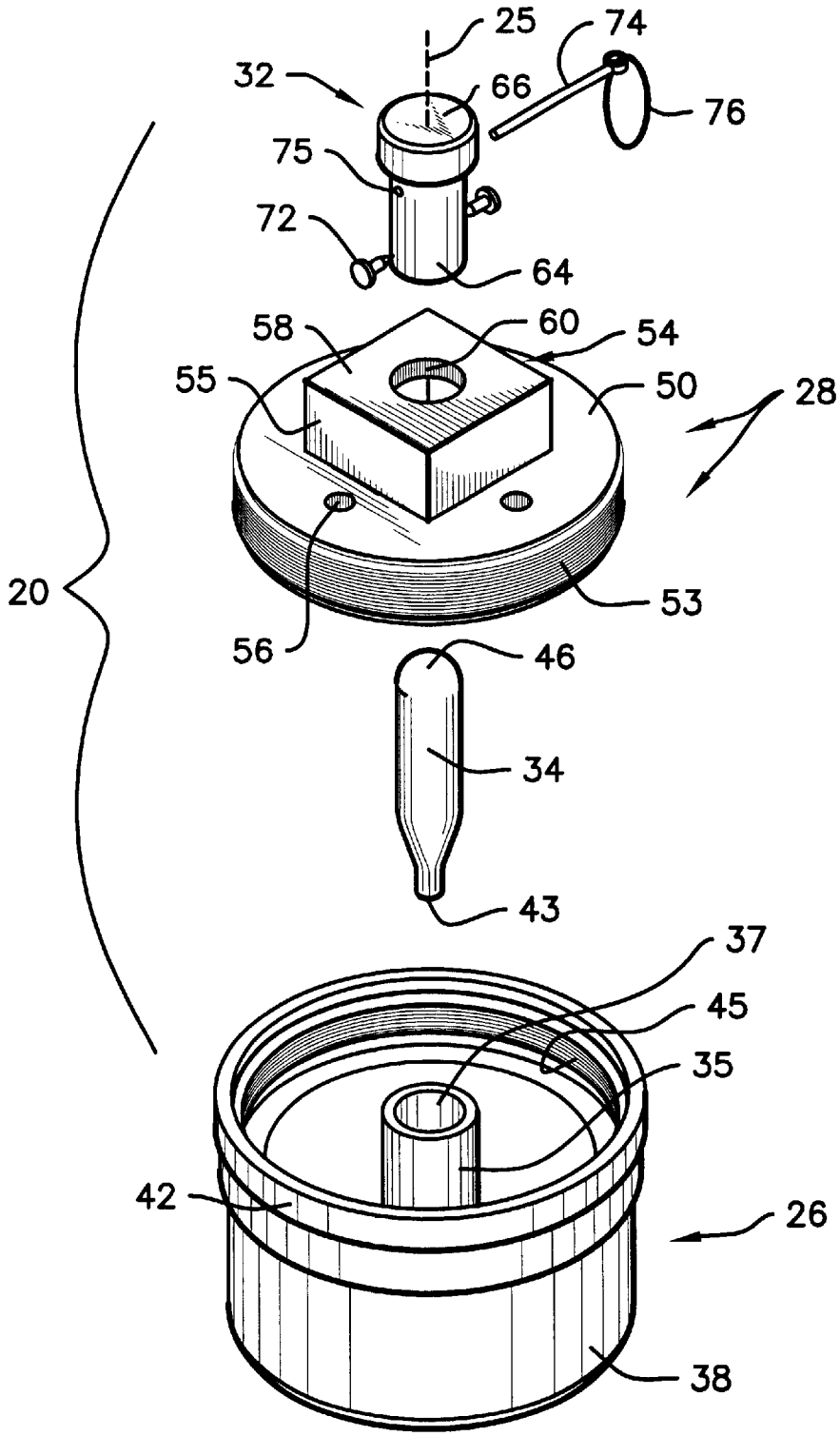
FIG. 8 is an exploded isometric view thereof.
Figure 9:
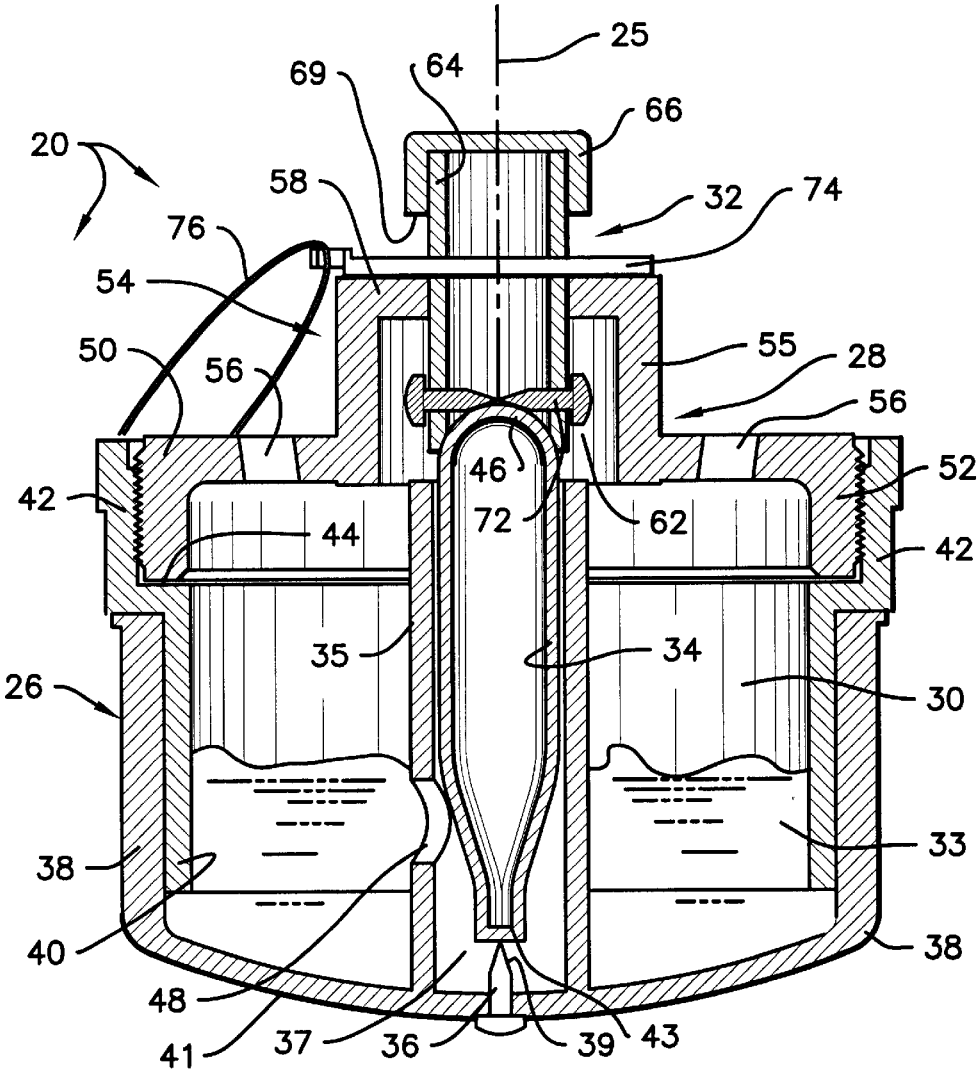
FIG. 9 is an enlarged, vertical sectional view thereof.

With additional reference concurrently directed to FIGS. 4–10, mine 20 is preferably assembled from multiple PVC plastic parts. It is generally cylindrical, with its parts generally concentrically arranged about its longitudinal axis 25 (FIGS. 8, 9). The solid, lower base 26 forms the bottom of the mine. Base 26 threadably receives an upper, PVC top, generally designated by the reference numeral 28. The interior 30 (FIG. 9) of the mine within base 26 below top 28 confines a quantity of colored dye or fluid, generally designated by the reference numeral 33, that is ejected when the mine fires. (In actual use, when the mine is filled with fluid, the level will be higher than that illustrated in FIG. 9.) Firing occurs when a pedestrian (not shown) steps on and thereby depresses detonator 32, forcing pressurized gas cartridge 34 downwardly within a coaxially centered cartridge storage tube 35 into penetrating, stabbing contact with puncturing pin 36. The gas cartridge 34 is freely slidable within tube 35 in above puncturing pin 36, coaxially centered with respect to the mine body and the detonator. When the cartridge is forced downwardly (i.e., as viewed in FIG. 9) and forcibly punctured, high pressure gases escape into the interior 30, forcing the fluid 33 upwardly and out of the mine.

Figure 10:
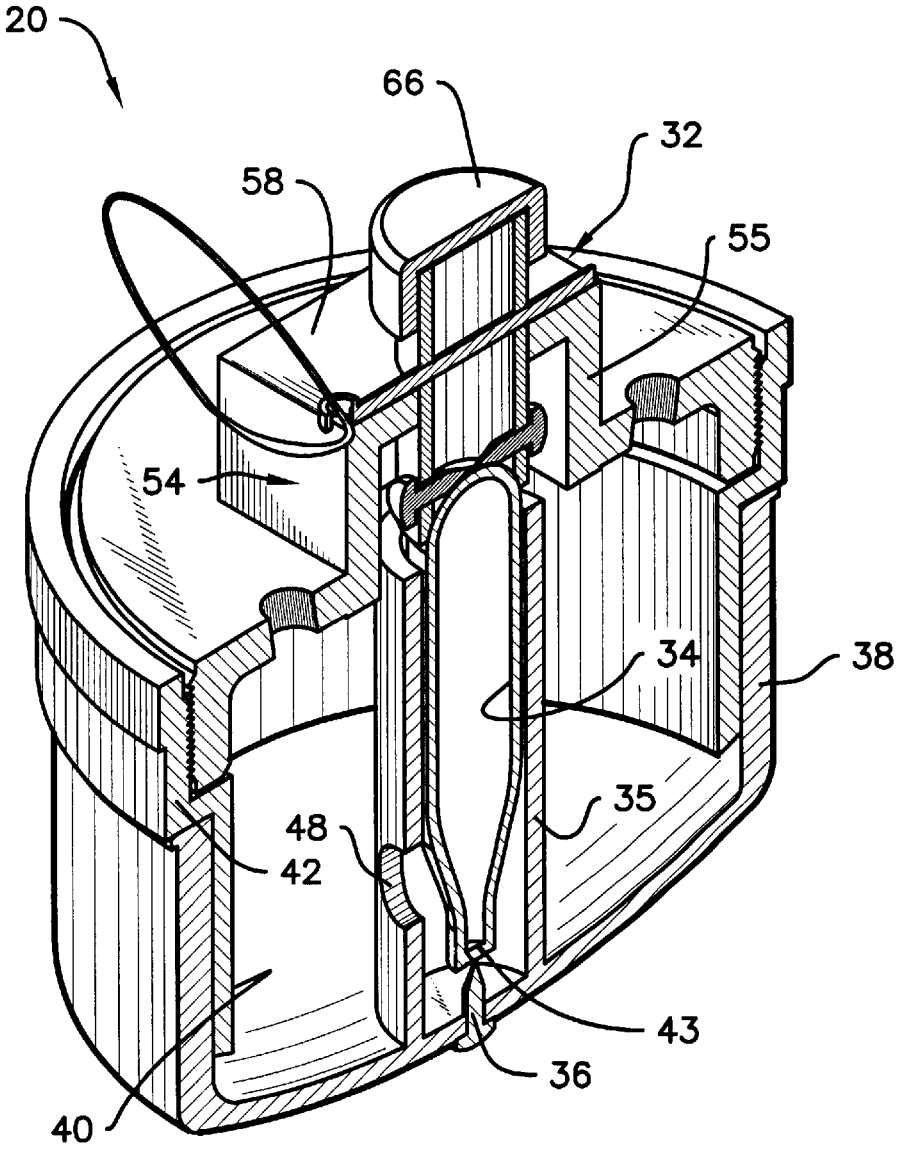
FIG. 10 is an enlarged, partially fragmentary isometric view thereof, with portions broken away or shown in section for clarity.

Preferably base 26 comprises two separate PVC pieces. Referring to FIGS. 8–10, base 26 comprises a rigid, PVC end cap 38 that is glued to a pipe 40. The external base bottom 41 (FIG. 3) concentrically receives the puncturing pin 36, formed from a screw whose sharp terminal shank 39 projects upwardly into the interior volume 37 of storage tube 35, concentrically with respect to mine interior 30. Puncturing pin 36 is coincident with respect to the longitudinal axis 25 of the mine. Cap 38, pipe 40, and storage tube 35 are coaxially aligned with respect to each other, and with respect to longitudinal axis 25 (FIG. 9). The gas cartridge 34 is positioned vertically within interior 37 of the storage tube 35 with its output end 43 (FIGS. 8, 9) disposed proximate shank 39. Tube 35 projects vertically upwardly within mine interior 30 towards the top 28, terminating proximate the detonator 32. The opposite end 46 (FIG. 8) of the gas cartridge 34 exits tube 35 slightly, being positioned adjacent the detonator 32 which can press the cartridge downwardly into puncturing contact with shank 39. When the cartridge seal is thus punctured, its compresses gases will rapidly exit the cartridge, forcibly entering and pressurizing the mine interior 30 beneath fluid 33 and top 28. Fluid flow between storage tube 35 and the mine interior 30 is facilitated by at least one discharge orifice 48 (FIGS. 9, 10) formed near the bottom of the cartridge storage tube, below the level of marker fluid or liquid 33 (FIG. 9) normally stored within the mine interior. Preferably a number of these orifices 48 may be radially spaced apart to preserve balance.

Pipe 40 has an integral, larger diameter, first flange 42 at its upper extremities. The first flange 42 is internally threaded so that it may threadably receive top 28. A shoulder 44 (FIG. 9) is formed between flange 42 and the pipe body 40. When the top 28 is tightly threadably installed and appropriately torqued, it makes firm contact with the shoulder 44 to seal the mine interior 30.

Top 28 comprises a flat, round deck 50 that is coaxially integral with a peripheral, larger diameter second flange 52 and an upwardly projecting dome 54. The upper outer surface of the top deck is denoted by reference numeral 51 (FIG. 2). Flange 52 comprises external screw threads 53 (FIG. 8) that mate with threads 45 in pipe flange 42 (FIG. 8). A plurality of radially spaced apart discharge passageways 56 are defined in deck 50. These venting passageways extend through deck 50 into fluid flow communication with mine interior 30. Preferably, discharge passageways 56 are angled somewhat acutely relative to axis 25, to externally aim traversing fluid upwardly away from the mine's center, thereby insuring a "hit."

The top's dome 54 is generally cubicle in shape. The spaced apart, upwardly projecting and planar dome walls 55 integrally extend between deck 40 and the dome's upper deck 58. As best seen in FIG. 8, there is a through-passageway 60 defined in upper deck 58, which is coaxial with the longitudinal axis 25 of the mine. The interior of the dome has been designated by the reference numeral 62 (FIG. 9). The detonator 32 is centered within and axially slidably disposed within passageway 60, entering dome interior 62 and contacting the upper end 46 of the gas cartridge 34.

Detonator 32 is made from reduced diameter PVC parts. The detonator comprises a tubular plunger 64 made from reduced diameter PVC pipe, which extends through the through-passageway 60 in upper deck 58 described earlier. A small, PVC end cap 66 externally seals the and terminates the plunger 64. The hollow bottom of the tubular plunger terminates within the dome interior 62, proximate the gas cartridge 34. When the plunger is depressed (i.e., the mine is contacted or stepped upon), plunger 64 moves into the mine interior, forcing the cartridge downwardly to break its seal and free the gas charge in response to penetration by pin 36. A peripheral ledge 69 (FIG. 9) formed by the bottom of plunger cap 66 limits plunger travel by contact with the upper outer surface of deck 58. The plunger is prevented from withdrawing from the dome 54 by a pair of internal retention screws 72 (FIGS. 8, 9) that transversely penetrate its lower tubular body. When plunger 64 is moved upwardly (i.e., during firing and reloading) screws 72 interfere with and contact the internal, underside of the dome's upper deck 58 to limit travel. It is temporarily (i.e., until used) retained against downward travel (and resultant mine detonation) by a transverse cotter pin 74 adapted to penetrate plunger body orifices 75 (FIG. 8). This cotter pin functions as a safety pin. With the safety pin 74 installed, interference upon upper dome deck 58 prevents plunger movement.

By grasping pin ring 76 and pulling the safety pin 74 loose from plunger 64, the mine is "armed," and sufficient force thereafter applied to the plunger will detonate the mine as aforedescribed. After a detonation, the mine may be easily reloaded and "reset." Preferably, after the mine is dug out of its former hiding place in the ground, remnants of the discharged marker fluid are cleaned from the mine's PVC surface my a soft moist rag. Reloading consists of cartridge replacement, combined with fluid refilling. The top 28 is simply unscrewed from the lower base 26 to allow access to the interior. The square shape of the top's dome 54 allows convenient manipulation either by hand or with a simple wrench. When the top is removed, cartridge 34 is withdrawn and a replacement is inserted. After refilling the liquid or fluid 33, the mine is reassembled, and thereafter re-deployed as in FIG. 1.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable land mine for training and for playing paint ball, the mine comprising:

a center;

a central longitudinal axis at the center of the mine;

a lower base concentric with the axis, wherein the base comprises a rigid end cap forming a mine bottom that is coaxially united with a tubular portion comprising a first threaded flange;

a top adapted to be concentrically coupled to the base, wherein the top comprises a second threaded flange adapted to be threadably coupled to said first flange to threadably, coaxially unite the top and the bottom of the mine;

an interior formed between said base and said top adapted to contain marker fluid that is forcibly ejected from the mine upon detonation;

wherein the first flange defines a shoulder for contacting with the second flange to seal the mine interior;

a cartridge containing pressurized gas disposed vertically within said interior substantially coaxially with respect to said axis, said base and said top;

a puncturing pin disposed proximate said cartridge for selectively puncturing the cartridge in response to cartridge movement to detonate the mine, the puncturing pin positioned coaxially relative to said axis;

a detonator comprising a plunger that is coaxially, slidably mounted to said top which forces said cartridge downwardly into penetrating engagement with said puncturing pin upon sufficient contact, thereby forcibly pressuring said mine interior; and, a plurality of fluid discharge passageways defined in said top establishing fluid flow communication for venting the mine interior and directing discharged fluid.

2. The mine as defined in claim 1 further comprising a cartridge storage tube disposed concentrically at the center of the mine for slidably captivating the cartridge, and at least one discharge orifice defined in the storage tube below the level of stored liquid for conducting gases to the mine interior.

3. The mine as defined in claim 2 wherein the puncturing pin concentrically enters said storage tube and said cartridge is vertically slidable within said tube into contact with said puncturing pin.

4. The mine as defined in claim 1 wherein the top comprises a lower deck that is coaxially integral with said second flange, and an integral dome projecting upwardly from said lower deck and terminating in an upper deck.

5. The mine as defined in claim 4 wherein said plunger coaxially, slidably penetrates said upper deck.

6. The mine as defined in claim 4 wherein said discharge passageways are formed in said lower deck of said top and radially spaced apart about said longitudinal axis.

7. The mine as defined in claim 6 wherein said discharge passageways form acute angles relative to said axis to symmetrically direct fluid away from the mine center.

8. The mine as defined in claim 6 wherein the dome is generally cubicle.

9. The mine as defined in claim 6 wherein the upper deck has a through-passageway that is coaxial with the longitudinal axis of the mine and through which the detonator plunger slidably extends.

10. The mine as defined in claim 9 wherein the dome forms an interior, and the gas cartridge at least partially enters said dome interior.

11. The mine as defined in claim 1 wherein the detonator comprises an upper end cap attached to said plunger, the detonator upper end cap comprising a peripheral ledge adapted to contact the top to limit plunger travel.

12. The mine as defined in claim 11 wherein the detonator comprises retention means attached to the plunger interiorly of the mine for preventing withdrawal.

13. The mine as defined in claim 11 further comprising a safety pin penetrating the plunger body that normally prevents plunger movement, which can be removed to set the mine.

14. A portable, symmetrical land mine for training and for playing paint ball, the mine comprising:

a center;

a central longitudinal axis at the center of the mine;

a lower base concentric with the longitudinal axis;

a top concentrically coupled to the base;

an interior defined between said base and said top for containing marker fluid that is forcibly ejected from the mine upon detonation;

a cartridge containing pressurized gas disposed within said interior substantially coaxially with respect to said axis, said base and said top;

a puncturing pin disposed proximate said cartridge for selectively puncturing the cartridge to detonate the mine, the puncturing pin positioned coaxially relative to said axis;

plunger means coaxially, slidably mounted to said top for moving said cartridge into penetrating engagement with said puncturing pin upon physical contact, thereby forcibly pressuring said mine interior to detonate the mine;

fluid discharge passageway means defined in said top for venting the mine interior and directing discharged fluid;

wherein the base comprises a rigid end cap adapted to form the mine bottom that is coaxial with a tubular pipe comprising a first threaded flange;

wherein the top comprises a second threaded flange adapted to be threadably coupled to said first flange to threadably, coaxially unite the top and bottom; and, wherein the first flange defines a shoulder for contacting the second flange upon assembly to seal the mine interior.

15. The mine as defined in claim 14 further comprising a storage tube disposed concentrically within said mine for slidably captivating the cartridge, and at least one discharge orifice defined in the storage tube below the level of stored liquid for conducting gases to the mine interior.

16. The mine as defined in claim 15 wherein the top comprises a lower deck that is coaxially integral with said second flange, and an integral dome projecting upwardly from said lower deck and terminating in an upper deck, and wherein said plunger means coaxially, slidably penetrates said upper deck.

17. The mine as defined in claim 16 wherein said discharge passageway means are formed in said lower deck of said top and radially spaced apart about said longitudinal axis.

18. The mine as defined in claim 16 wherein said discharge passageway means form acute angles relative to said axis to symmetrically direct fluid away from the mine center.

19. A portable paint ball land mine comprising:

a central longitudinal axis;

a lower coaxial base comprising a rigid bottom and a tubular portion having a first threaded flange;

a top comprising a lower deck having a second threaded flange threadably coupled to said first flange, and an integral dome projecting upwardly from said lower deck and terminating in an upper deck;

an interior formed between said base and said top adapted to contain marker fluid that is forcibly ejected from the mine upon detonation;

a cartridge storage tube disposed concentrically within the mine;

a cartridge containing pressurized gas that is slidably disposed within said storage tube;

a puncturing pin for selectively puncturing the cartridge in response to cartridge movement to detonate the mine, the puncturing pin positioned coaxially within said storage tube;

a detonator plunger that is coaxially, slidably mounted to said top which forces said cartridge downwardly into penetrating engagement with said puncturing pin to forcibly pressure said mine interior, said plunger coaxially, slidably penetrating said upper deck; and, a plurality of fluid discharge passageways defined in said top's lower deck for venting the mine interior and directing discharged marker wherein said discharge passageways are radially spaced apart about said longitudinal axis, and said orifices form acute angles relative to said axis to symmetrically direct fluid away from said top; and, wherein the dome comprises a through-passageway that is coaxial with the longitudinal axis of the mine, and the plunger is slidably mounted within said through-passageway;

wherein the plunger comprises retention means for preventing withdrawal of the plunger from said passageway; and, wherein the mine comprises a removable safety pin penetrating the plunger body that normally prevents plunger movement, but which can be removed to set the mine.

* * * * *